US008813648B2

(12) United States Patent
Remahl

(10) Patent No.: US 8,813,648 B2
(45) Date of Patent: Aug. 26, 2014

(54) IGNITION AND DELAY CIRCUIT

(75) Inventor: Henrik Remahl, Västerås (SE)

(73) Assignee: SAAB AB, Linköping (SE)

( * ) Notice: Subject to any disclaimer, the term of this patent is extended or adjusted under 35 U.S.C. 154(b) by 139 days.

(21) Appl. No.: 13/127,785

(22) PCT Filed: Nov. 5, 2008

(86) PCT No.: PCT/SE2008/000626
§ 371 (c)(1),
(2), (4) Date: Sep. 30, 2011

(87) PCT Pub. No.: WO2010/053407
PCT Pub. Date: May 14, 2010

(65) Prior Publication Data

US 2012/0012020 A1 Jan. 19, 2012

(51) Int. Cl.
*F42C 1/00* (2006.01)
*F42C 11/02* (2006.01)
*F42C 11/06* (2006.01)

(52) U.S. Cl.
USPC ..... 102/210; 102/215; 102/216; 102/266; 102/276

(58) Field of Classification Search
USPC ..... 102/206, 207, 210, 215, 216, 218, 262, 102/264, 265, 266, 272, 276; 361/248, 250, 361/251, 252
See application file for complete search history.

(56) References Cited

U.S. PATENT DOCUMENTS 3,967,555 A * 7/1976 Gawlick et al. ..... 102/210
3,967,556 A * 7/1976 Post et al. ..... 102/209
4,393,779 A * 7/1983 Brede et al. ..... 102/202.5
5,180,882 A 1/1993 Bansard
5,269,223 A 12/1993 Mattsson et al.
5,705,766 A 1/1998 Farace et al.
6,785,116 B1 8/2004 Hummel et al.
6,865,989 B2 3/2005 Kölbli
8,042,469 B2 * 10/2011 Rastegar et al. ..... 102/210
8,286,554 B2 * 10/2012 Rastegar et al. ..... 102/210
2008/0121131 A1 5/2008 Pikus et al.

FOREIGN PATENT DOCUMENTS

DE 10020037 C1 8/2001
GB 2257776 A 1/1993
WO WO-9415169 A1 7/1994
WO WO-98/26248 A1 6/1998

OTHER PUBLICATIONS

PCT/ISA/210—International Search Report—Jun. 16, 2009.
PCT/ISA/237—Written Opinion of the International Searching Authority—Jun. 16, 2009.
European Search Report—May 2, 2013—Counterpart Issued in Application No. 08878017.6.

* cited by examiner

*Primary Examiner* — James Bergin
(74) *Attorney, Agent, or Firm* — Venable LLP; Eric J. Franklin

(57) ABSTRACT

An ignition and delay circuit of an ammunition unit for time controlled delay of the initiation of an electric blasting cap. The ignition and delay circuit includes a piezo electric device generating electrical energy when hitting a target. An energy storing device stores the energy generated by the piezo electric device. A delay device supplied by the energy storing device and controlling the initiation of the electric blasting cap. A programmable micro processor is provided supplied by the energy storing device and arranged to control the delay of the initiation in dependence of at least the type of ammunition in question.

9 Claims, 1 Drawing Sheet

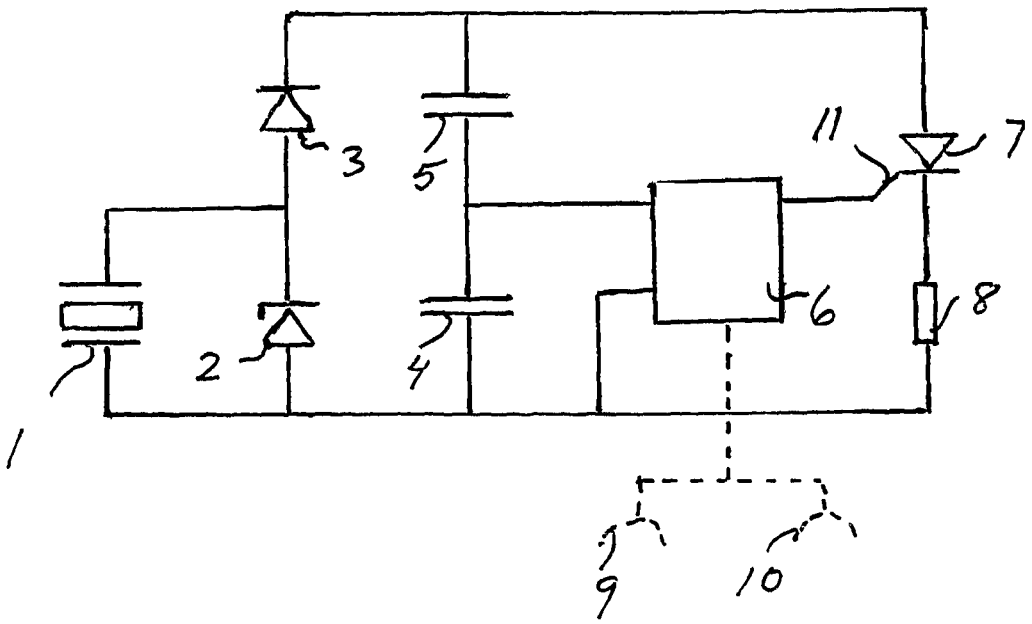
1
2
3
4
5
6
7
8
9
10
11

IGNITION AND DELAY CIRCUIT

CROSS-REFERENCE TO RELATED APPLICATIONS

This application is the national phase of PCT/SE2008/000626 filed 5 Nov. 2008.

FIELD OF THE INVENTION

The present invention relates to an ignition and delay circuit of an ammunition unit for time controlled delay of the initiation of an electric blasting cap comprising a piezo electric device generating electrical energy when hitting a target, an energy storing device storing the energy generated by the piezo electric device and a delay device supplied by the energy storing device and controlling the initiation of the electric blasting cap.

BACKGROUND OF THE INVENTION

An example of such an ignition and delay circuit is previously known from published international application WO9415169A1. According to this patent document there is an ignition and delay circuit delaying the ignition pulse. The delay period is set in advance. The delay is carried out by hard ware that only manages to count down a preset time period before forwarding an ignition pulse.

In weapon systems of today there is a demand for more flexible ignition and delay circuits. The delay and ignition circuit should be easy to adapt to different ammunition types, different kinds of operations, different kinds of environments and so on. There is also a demand for ignition and delay circuits with higher accuracy, consuming less electricity available to a low cost.

SUMMARY OF THE INVENTION

The object of the invention is to offer an ignition and delay circuit better fulfilling the above demands.

According to our proposed solution a programmable micro processor is provided supplied by the energy storing device and arranged to control the delay of the initiation in dependence of at least the type of ammunition in question. By the introduction of a programmable micro processor offering full programmability a very flexible ignition and delay circuit is obtained. Such a solution based upon a micro processor does not only count a preset time period but offers a great variety within the frames of its machine code. In addition to only presetting a time period, the micro processor can be used to read external sensors, carry out signal processing and so on.

Accordingly, the ignition and delay circuit is capable to take logical decisions when to forward an ignition pulse not only based upon a preset time period but also based upon a number of different incoming signals. The solution offers the possibility to program the ignition and delay circuit to quite different performance and time periods in dependence on the application in question.

According to a favourable development of the ignition and delay circuit the programmable micro processor in addition to the type of ammunition is arranged to control the initiation in consideration of further input signals supplied by comprised sensors.

Suitably the programmable micro processor of the ignition and delay circuit is supplied by an energy storing device comprising a first and a second capacitor in series, the processor being connected in parallel with the first of the capacitors to be supplied from it. In this connection it is also proposed that a first and a second diode, the diodes being arranged to conduct in the same direction, are coupled in series in parallel to the first and second capacitors in series and that the piezo electric device is connected in parallel to the first diode. By means of this arrangement of capacitors and diodes coupled to the piezo electric device the voltage generated by the piezo electric device can be limited and adjusted such that the voltage generated directly can supply the micro processor without to run the risk of overloading or damaging the micro processor. The piezo electric device or piezo electric crystal generates enough with energy at a target hit to support the micro processor and thereafter to initiate the electric blasting cap.

According to a preferred embodiment the first diode is of Zener-diode type. Such a diode operates as a surge protection and effectively prevents the voltage across the first and second capacitor in series to pass a predetermined value. In brief the Zener-diode operates such that it at a certain value of the voltage begins to conduct and dumps surplus energy to earth.

According to a further preferred embodiment of the delay and ignition circuit a semiconductor component with a gate controlled by the processor is coupled in series with the electric blasting cap, the coupling in series of the semiconductor component and the electric blasting cap being coupled in parallel to the coupling in series of the first and second capacitor. Examples of suitable semiconductor components in this connection are thyristors and transistors such as Avalanche transistors. Such components are easily controlled by the micro processor and ensure in a conducting state that energy stored in the first and second capacitor can be supplied to the electric blasting cap.

BRIEF DESCRIPTION OF THE DRAWINGS

The invention will now be described in more detail with reference to the accompanying drawing in which the only FIGURE shows an example of a suitable circuitry showing the critical components required to obtain intended operation.

DETAILED DESCRIPTION OF EMBODIMENTS OF THE INVENTION

The circuitry shown comprises a piezo electric crystal 1 in parallel with a first diode 2. A second diode 3 is connected in series with the first diode 2. A first capacitor 4 and a second capacitor 5 in series are arranged parallel to the first and second diodes 2, 3. A micro processor 6 is arranged to be energy supplied from the first capacitor 4. A semiconductor component such as a transistor 7 or thyristor in series with an electric blasting cap 8 is also arranged in parallel to the first and second diodes 2, 3. An output signal of the micro processor is connected to the gate 11 of the semiconductor component 7 to control the conducting state of the semiconductor component 7. It is also indicated in the FIGURE by broken lines that the processor 6 could be connected to external sensors 9,10.

The piezo electric crystal 1 is of the type that normally are used in projectiles fired from shoulder launched weapons, such as a weapon named Carl-Gustav or disposable weapons such as a weapon named AT4. Such a piezo electric crystal can be used both as a target sensor and for generation of energy to drive electronic circuits and initiate an electric blasting cap.

The first diode 2 is an overvoltage protecting diode. The diode 2 operates as an overvoltage protection and prevents the voltage across the first and second capacitor 4,5 to pass a predetermined value. A Zener-diode, a transient protecting diode or similar diodes can be used. The operation of the diode 2 is such that the diode starts to conduct at a certain value of the voltage across it and dumps the surplus energy to earth.

The second diode is a standard diode component and has for its object to prevent involuntary discharge to ground of the first and second capacitor 4, 5.

The object of the first and second capacitors 4, 5 is to store the energy from the piezo electric crystal 1 so that it can be used for initiation and supplying of the electronics involved. The capacitors are dimensioned such that suitable ignition levels are obtained for the initiation and such that the voltage division between the first and second capacitors 4, 5 provides suitable drive voltage to the micro processor 6.

Suitable micro processors are chosen in dependence on inter alia required capacity and environmental conditions such as shock and moisture resistance.

The semiconductor component 7 is a suitable transistor or thyristor that upon signal at its gate from the micro processor can discharge the capacitors 4, 5 to ground through the electric blasting cap 8.

In brief the operation of the ignition and delay circuit can be described as follows. When a projectile fired from a weapon, such as an shoulder launched weapon, housing an ignition and delay circuit according to the invention and the projectile with the ignition and delay circuit hits a target, the piezo electric crystal 1 generates energy. This energy is temporarily stored across the capacitors 4, 5 under the control of the first and second diodes 2, 3. The first diode 2 prevents the voltage across the first and second capacitor 2,3 from passing a predetermined value and the second diode 3 prevents unintended discharging of the first and second capacitors 4, 5. The voltage across the first capacitor 4 supplies the micro processor 6 with energy starting up the micro processor processing introducing a delay in the activation of the semiconductor component 7. The delay is dependent on the software loaded in the micro processor of the ammunition involved and if preferred on information read from comprised sensors 9,10. When the correct triggers are fulfilled, i.e. delay time, sensor reading etc, the processor 6 activates the gate 11 of the semiconductor component 7 setting the semiconductor component 7 in a conducting state. The energy stored across the first and second capacitors are now discharged to ground through the electric blasting cap 8. The discharge to ground trough the electric blasting cap 8 results in that the electric blasting cap detonates a not shown explosive charge.

The circuitry described above is to be regarded as a general basic construction. However, variants of the circuit solutions are possible within the scope of the invention without departing from the basic construction described.

The invention claimed is:

1. An ignition and delay circuit of an ammunition unit for time controlled delay of an initiation of an electric blasting cap, the ignition and delay circuit comprising:

a piezo electric device generating electrical energy when hitting a target, an energy storing device storing the energy generated by the piezo electric device, and a delay device supplied with energy by the energy storing device and arranged to control an initiation of the electric blasting cap, the delay device comprising a programmable micro processor supplied with energy by the energy storing device and arranged to control a delay of the initiation in dependence of at least a type of the ammunition unit.

2. The ignition and delay circuit according to claim 1, wherein the programmable micro processor and the type of ammunition are arranged to control the initiation in consideration of input signals supplied by sensors.

3. The ignition and delay circuit according to claim 1, wherein the programmable micro processor is supplied by the energy storing device comprising a first and a second capacitor in series, the processor being connected in parallel with the first of the capacitors to be supplied from it.

4. The ignition and delay circuit according to claim 3, further comprising:

a first diode and a second diode arranged to conduct in a same direction, wherein the first diode and the second diode are coupled to each other in series, wherein the first diode and the second diode are coupled in parallel to the first and second capacitors, and wherein the piezo electric device is connected in parallel to the first diode.

5. The ignition and delay circuit according to claim 4, wherein the first diode is a Zener-diode type.

6. The ignition and delay circuit according to claim 3, further comprising:

a semiconductor component with a gate controlled by the processor, wherein the semiconductor component is coupled in series with the electric blasting cap, the coupling in series of the semiconductor component and the electric blasting cap being coupled in parallel to the coupling in series of the first and second capacitor.

7. The ignition and delay circuit according to claim 6, the semiconductor component is a thyristor.

8. The ignition and delay circuit according to claim 6, wherein the semiconductor component comprises a transistor.

9. The ignition and delay circuit according to claim 8, wherein the semiconductor component comprises an Avalanche transistor.

* * * * *